United States Patent [19]

Fujiwara et al.

[11] 4,264,186

[45] Apr. 28, 1981

[54] ELECTROPHOTOGRAPHIC COPYING APPARATUS

[75] Inventors: Takao Fujiwara, Toyokawa; Kidetoshi Kawabata, Tondabayashi; Masaya Ogawa; Tatsuya Okada, both of Osaka, all of Japan

[73] Assignee: Minolta Camera Kabushiki Kaisha, Osaka, Japan

[21] Appl. No.: 954,622

[22] Filed: Oct. 25, 1978

[30] Foreign Application Priority Data

Nov. 4, 1977 [JP] Japan ..... 52/133326

[51] Int. Cl.[3] ..... G03G 15/00

[52] U.S. Cl. ..... 355/14 R; 355/3 R

[58] Field of Search ..... 355/14 R, 14 C, 3 R, 355/8

[56] References Cited

U.S. PATENT DOCUMENTS

| | | | |
|---|---|---|---|
| 3,914,046 | 10/1975 | Tanaka et al. | 355/3 DD |
| 3,960,446 | 6/1976 | Ogawa et al. | 355/13 |
| 3,976,375 | 8/1976 | Kurita et al. | 355/14 R |
| 4,139,300 | 2/1979 | Katayama et al. | 355/14 R |

*Primary Examiner*—Richard L. Moses

*Attorney, Agent, or Firm*—Wenderoth, Lind & Ponack

[57] ABSTRACT

An electrophotographic copying apparatus has a drum with an endless photoconductive material on its periphery and has arranged around the periphery of the photoconductive drum an eraser unit, a charging unit, a slit exposure unit, a developing unit, a transfer unit and a cleaning unit disposed within or close to the developing unit. The charging, exposure and developing units are operable during the first revolution of the photoconductive drum to form an image thereon, the cleaning unit being operable to clean the surface of the photoconductive drum during the second revolution thereof. The photoconductive drum in the course of the second revolution is adapted to rotate until the rear end of the image formed on the photoconductive drum has passed the charging unit, whereupon one copying cycle is completed. The front end of the image to be subsequently formed can be positioned on a portion of the photoconductive drum other than where the front end of the image formed during the abovementioned cycle is positioned.

5 Claims, 5 Drawing Figures

PC1
PC2
PC3
SL
SWP

ELECTROPHOTOGRAPHIC COPYING APPARATUS

BACKGROUND OF THE INVENTION

1. Field of the Invention

The present invention relates to an electrophotographic copying apparatus of the powder image transfer type having a rotary photoconductive drum and a slit exposure unit, and more particularly to a copying apparatus of this type in which a cleaning unit disposed within or close to the developing unit is adapted to clean the photoconductive drum during the second revolution thereof following the first revolution of the drum during which an image is formed.

2. Description of the Prior Art

Copying apparatuses of this type are disclosed, for example in Japanese Laid Open Patent Applications Nos. SH 52-117136, and SHO 51-106440 and U.S. Pat. No. 4,074,934. Because the cleaning unit is positioned close to the developing unit or the magnetic brush of the developing drum used as a cleaning unit, such copying apparatuses have the advantages that the toner removed from the photoconductive surface can easily be reused and that the apparatus has an overall compact construction.

Such an apparatus nevertheless has drawbacks. When making one copy, it carries out the charging, exposing, developing and transferring steps during the first turn of the photoconductive drum and carried out a cleaning operation during the second turn of the drum, thus necessitating one more turn of the photoconductive drum for a copying cycle than in copying machines in which the developing unit and cleaning units are spaced relatively far from each other. Additionally, the copying operation, even when it is for making a copy of a small size original, requires two revolutions of the drum which has a circumference at least equal to the length of the largest copy size, with the result that the portion of the photoconductive member which is substantially unused for copying must be moved a great amount, which is inefficient.

Further, because the photoconductive drum is adapted to make two revolutions for each copying cycle, the front end of the image formed on the drum for each copy is always positioned on the same portion of the photosensitive surface. This leads to degradation of that portion, making the photoconductive member unserviceable after only a short period of time. Another serious objection is that when the drum is used for copying an original having an increased length after making a large number of copies having a short length, the deteroriation of the one portion of the drum will cause a difference in the quality between the front and rear portions of the reproduced image.

SUMMARY OF THE INVENTION

It is a principal object of the present invention to provide an electrophotographic copying apparatus with which it is possible to perform charging, exposing, developing and transferring steps during the first revolution of the photoconductive drum thereof and to complete one copying cycle during the course of the second revolution of the drum after the rear end of the image formed on the photoconductive drum surface by the abovementioned steps has been moved past the charging position by the rotation of the drum, thereby eliminating idle rotation of the drum while permitting the subsequent copying cycle to form an image on the drum with the front end of the image shifted from the front-end position of the first mentioned image and preventing the drum from local degradation of a particular portion of the drum which would otherwise result.

Another object of the present invention is to provide an electrophotographic copying apparatus in which the photoconductive drum, during the course of the second revolution, rotates until the rear end of the image forming area has passed the charging position so that the toner left unremoved from the drum at the rear end of the image forming area is prevented from scattering when the charging unit operates during the initial stage of the subsequent copying cycle.

Still another object of this invention is to provide an electrophotographic copying apparatus which can automatically regulate the amount of rotation of the photoconductive drum in accordance with the transport of the original.

These objects are achieved according to the invention by the provision of an electrophotographic copying apparatus comprising: a rotatable drum member having an endless photoconductive surface; a charging means for charging the photoconductive surface; exposure means for projecting an optical image of an original to be copied onto the charged photoconductive surface and having an exposure lamp, scanning means for scanning the original and an optical system; developing means for developing an electrostatic latent image formed on the photoconductive surface by means of tone particles; transfer means for transferring the toner image formed on the photoconductive surface to copying material; erasing means for erasing the residual charges on the photoconductive surface; said charging means, exposure means, developing means, transfer means and erasing means being spaced around said drum member in the recited order; cleaning means for removing the residual toner particles from the photoconductive surface disposed between the exposure means and the developing means; and control means connected to the respective means for electrically controlling the operation of at least the charging, exposing, developing, transfer and erasing means relative to the scanning means and the rotation of the photoconductive drum, when continuously making a plurality of copies from the same original, for the charging, exposure, developing and the transfer means during the first rotation of the photoconductive drum for forming of the image for the first copy to form the toner image thereon, and for operating the charging, exposure, developing and transfer means during the second rotation of the photoconductive drum to erase the image for the first copy and start the second image forming operation when the tail end of the image area on the photoconductive surface corresponding to the image formed during the first rotation of the drum has passed a portion of said charging means.

The above and other features and advantages of the invention will become more fully apparent from the following description taken with the annexed drawings which illustrate preferred embodiments of the invention.

DETAILED DESCRIPTION

Figure 1:
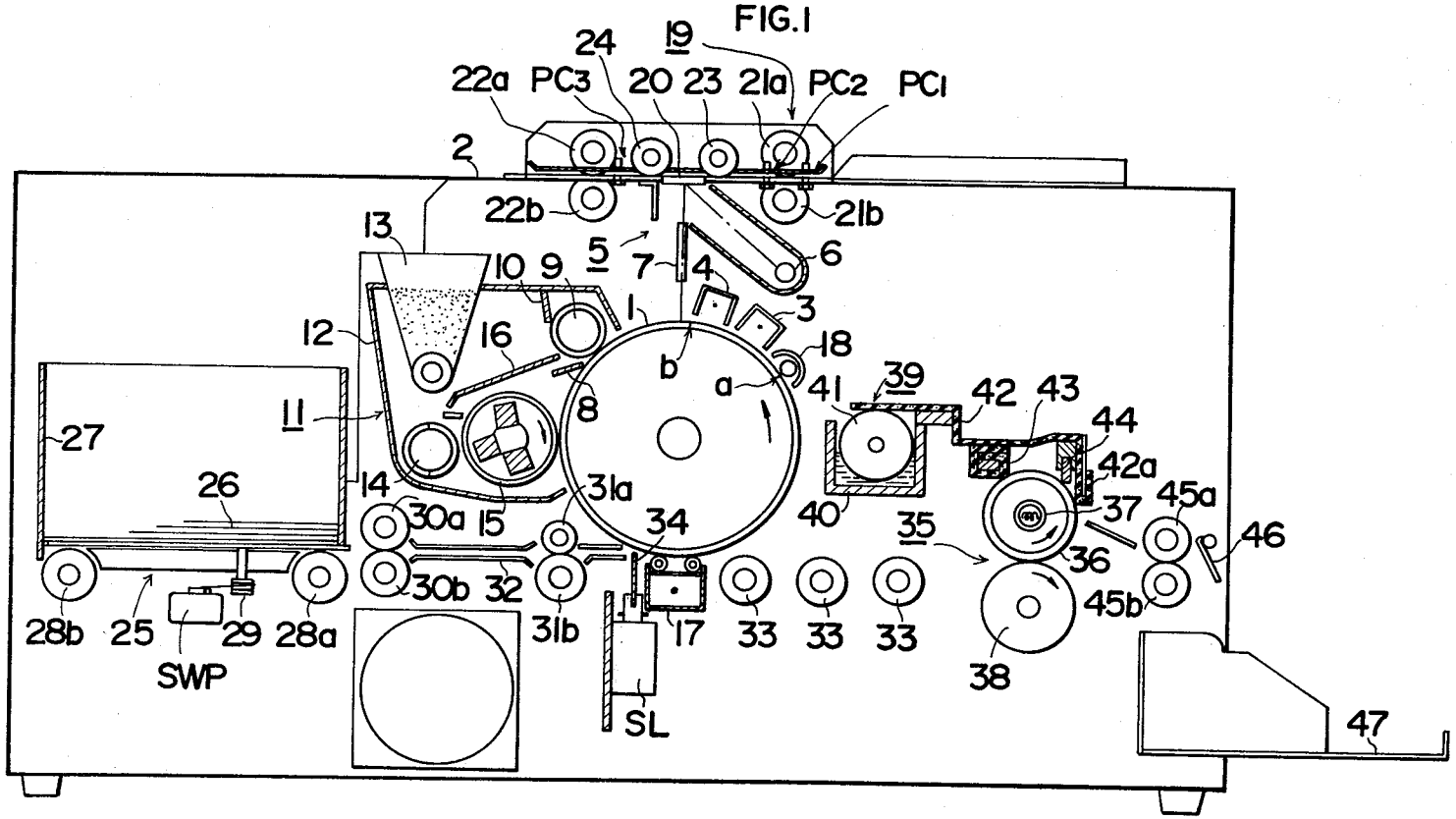
FIG. 1 is a sectional side elevation view showing one embodiment of an electrophotographic copying apparatus according to this invention.

The apparatus of FIG. 1 is for copying image bearing cards onto transfer cards, and comprises a photoconductive drum 1 disposed in the center of the main body 2 of the copying apparatus which is rotatable in the counterclockwise direction as indicated by the arrow. Positioned around the drum 1 are a discharge unit 3, a charging unit 4, an exposure unit 5 of the slit exposure type comprising a lamp 6 and an image transmitter 7 and formed of a bundle of optical fibers having graded refractive indexes, for example as disclosed in U.S. Pat. No. 3,658,407 and sold by Nippon Sheet Glass Co., Ltd., Japan under the name Selfoc, a developing unit 11 including a cleaning blade 8 of insulating material for removing residual toner and a toner recovering roller 9, a transfer unit 17 and an eraser lamp 18. These components are arranged one after another in the direction of rotation of the photoconductive drum 1. In the developing unit 11, toner is supplied from a feeder 13 to a casing 12 at a constant rate and is mixed with a carrier by a stirring roller 14. The mixture is fed onto a developing sleeve 15 having a permanent magnet in its interior to develop electrostatic latent images on the photoconductive drum 1 by the rotation of the developing sleeve 15.

The toner recovering roller 9 is disposed close to the surface of the drum 1 and is adapted to be triboelectrically charged by a rubber or thin metal piece 10 to a polarity opposite to that of the toner to electrostatically attract the residual toner scraped off the drum 1 by the cleaning blade 8. The thin piece 10 for triboelectrifying the toner recovering roller 9 also serves to scrape the toner off the roller 9 and feed the toner onto the stirring roller 14 by means of a guide plate 16 so that the recovered toner can be reused. Alternatively the toner attracted to the recovering roller 9 may be placed into a recovering container (not shown) and therafter discarded.

A feed means 19 for feeding an original to be copied is mounted on the top of the main body 2 and comprises feed rollers 21*a*, 21*b*, 22*a*, and 22*b* and holder rollers 23 and 24 for transporting an original (not shown) leftward in FIG. 1 over a glass plate 20. The image of the original is projected by the light from the lamp 6 onto the photoconductive drum 1 through the image transmitter 7. The holder rollers 23 and 24 also serve to prevent leakage of the light of the lamp 6.

Arranged in front of and to the rear of the feed rollers 21*a* and 21*b* and in front of the feed rollers 22*a* and 22*b* are photocouplers PC1, PC2 and PC3 comprising pairs of light projecting elements LD1, LD2 and LD3 and light receiving elements PH1, PH2 and PH3 respectively. The photocoupler PC1 functions as a switch for initiating the copying operation at the time of detecting the front end of the original fed to the nip of the feed rollers 21*a* and 21*b*. The photocouplers PC2 and PC3 act to detect the positions of the original at subsequent points to control the sequence of the copying steps as will be described in detail later.

A card containing unit 25 is adapted to dispense transfer cards 26 stacked in a casing 27 one by one from the bottom of the stack by means of a dispenser roller 28*a*. Shown at 28*b* is an idle roller. Disposed at the lower portion of the unit 25 is a card detecting switch SWP having a detecting member 29 for detecting the absence of a card 26 from the casing 27. The path along which the transfer card 26 is transported is established by feed rollers 30*a*, 30*b*, 31*a* and 31*b*, guide plates 32 and three conveyor rollers 33. The conveyor rollers 33 have rough surfaces, such as knurled surfaces. At the terminal end of the path are provided a fixing unit 35, a pair of discharge rollers 45*a* and 45*b* and a guide 46. A stop 34 which is movable by a solenoid SL is provided at an intermediate position along the path immediately ahead of the transfer unit 17. The stop 34 serves to control the feed of a card 26 to the transfer position in timed relation to the movement of the latent image on the drum 1. The card 26 fed by the feed rollers 30*a*, 30*b*, 31*a* 31*b* is temporarily halted by the stop 34, which is thereafter retracted from the path of the transfer card by the solenoid SL when the solenoid is actuated in response to a suitable signal, permitting the feed of the card 26 to the transfer position. The feed rollers 30*a* and 31*a* are idle rollers which are driven by rollers 30*b* and 31*b*. The conveyor rollers 33 for forwarding the card 26 from the transfer position are positively driven. The card 26 can be conveyed by these means because it is thick.

The fixing unit 35 comprises a heated roller 36 having a heat source 37 therein and a press roller 38. The heated roller 36 is provided with a silicone oil applicator 39 for preventing offset. The applicator 39 includes a container 40 containing silicone oil, which is supplied by a roller 41 to applicator members 42 and 43 made, for example, of felt and then applied to the heated roller 36. The silicone oil on the heated roller 36 is removed by a blade 44 and also absorbed by a portion 42*a* of the applicator member 42 for reuse.

The guide 46 is provided to eliminate warp from the toner image-bearing card 26 delivered from the fixing unit 35. In the present embodiment, which is a card printer, only the heated roller 36 is heated to thereby fix toner images on cards which come in contact therewith, since the cards 26 have a relatively large thickness. Consequently the heat of the roller 36 and the pressure of press roller 38 applied to the card produce a warp in the card 26. The guide 46, which is inclined downward, acts to remove the warp.

In the apparatus constructed as described above, the front end of an original, when placed into the nip of the feed rollers 21*a* and 21*b*, actuates the photocoupler PC1, which in turn energizes the eraser lamp 18 and a main motor. When the motor is energized, the photoconductive drum 1 starts to make the first revolution in a counterclockwise direction as seen in FIG. 1. The photocoupler PC2, when actuated by the leading end of the original, energizes the discharge unit 3 and the charging unit 4. Consequently the peripheral surface of the drum 1 is erased, then discharged and thereafter charged, first at the front-end position a of an image. At the same time, the photocoupler PC2 turns on the lamp 6. The feed rollers 21*a*, 21*b*, 22*a* and 22*b* are also started in rotation by the actuation of the photocoupler PC1 and move the original leftward in FIG. 1 at the same speed as the peripheral speed of the drum 1. The image of the original is progressively projected onto the drum 1 by the exposure unit 5 to form an electrostatic latent image on the drum. The latent image is developed to a toner image when it passes the developing unit 11 which is actuated by actuation of the photocoupler PC3.

On the other hand, upon actuation of the photocoupler PC2, the lowermost of the transfer cards 26 is delivered from the card containing unit 25 by the rotation of the dispenser rollers 28*a* and 28*b*. The card 26 is forwarded by the feed rollers 30*a*, 30*b*, 31*a* and 31*b* and then temporarily stopped by the stop 34. The solenoid SL is energized by the timing system to be described later so that the forward end of the card will reach the transfer position when the front end a of the image on the drum 1 reaches the transfer position. The card is thereafter transported at a speed equal to the peripheral speed of the drum 1 to the transfer position, at which the toner image is transferred onto the card 26 by the unit 17. The conveyor rollers 33 feed the card 26 to the fixing unit 35. The image is fixed as the card 26 is passed between the heated roller 36 and the press roller 38. The card 26 is delivered from the apparatus onto a tray 47 by the discharge rollers 45*a* and 45*b*. When the original has passed the photocoupler PC3, the exposure lamp is turned off, and the feed rollers 21*a*–22*b* are reversely driven to return the original to the initial feed position.

The photoconductive drum 1 continues to rotate after the image transfer and is irradiated by the erase lamp 18, by which residual charges are erased. During the subsequent second revolution, the residual toner is scraped off the drum 1 by the cleaning blade 8 and electrostatically attracted to the recovering roller 9 for recovery.

It is theoretically possible to rotate the photoconductive drum 1 during the course of the second revolution by an amount corresponding to the length of the original until the rear end of the image forming area reaches the eraser lamp 18 and to position the front and a of the image forming area for the next copy at the rear end of the above-mentioned image forming area so as to use the photoconductive surface continuously. However, this will entail the difficulty that when the charging and discharging units 3 and 4 are energized for the next copying cycle, particles of the residual toner on the drum surface will be scattered under the influences of the discharging action.

Accordingly it is necessary to rotate the drum 1 in the second revolution a peripheral distance larger than the length of the image forming area to bring the rear end of the area to a position where it will not be affected by the action of the charging and discharging units 3 and 4. This position is indicated at b in FIG. 1 just past the charging unit 4.

This leads to a shift of the image forming area on the photoconductive member as will be described below with reference to FIG. 2.

In copying machines in which the photoconductive member is adapted to make two revolutions for one copying cycle, the photoconductive member usually has a circumferential dimension equal to the length of the largest copy size. As illustrated in FIG. 2 (I), the photoconductive surface during the first revolution A is subjected to erasure, charging, exposure, development and transfer to obtain a copy image, and the photoconductive surface furing the second revolution B is cleaned. The photoconductive surface during the third revolution C is subjected to the same actions as in revolution A, and in the fourth revolution D to the same actions as in revolution B.

Figure 2:
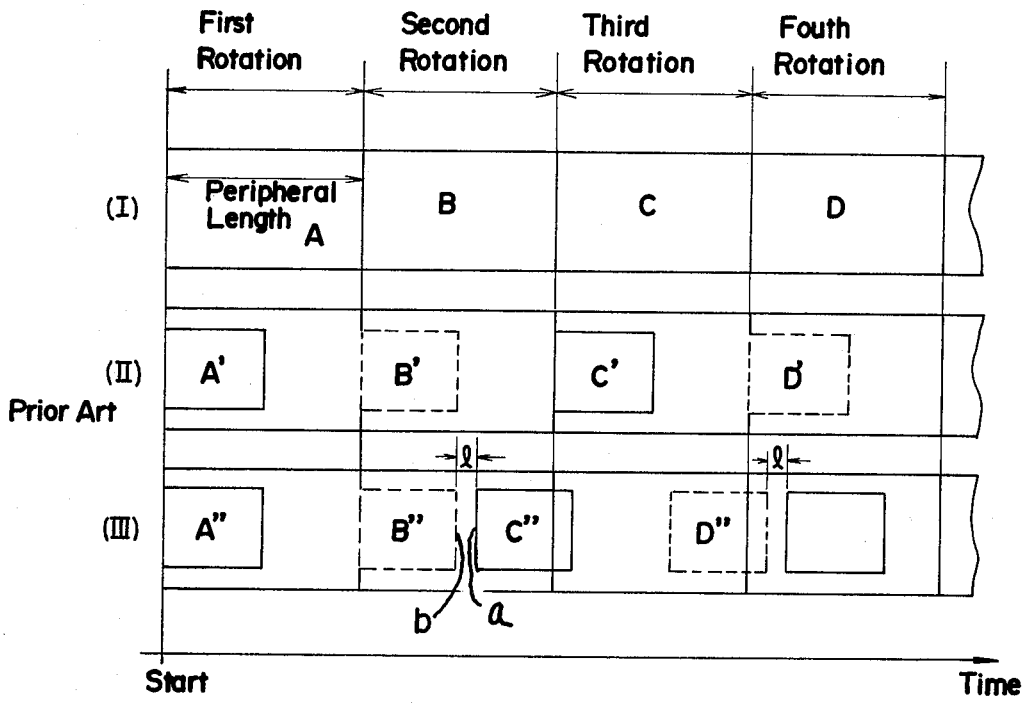
FIG. 2 is a diagram showing the relation between the rotation of the photoconductive drum of the present apparatus and the copies being made.

When making copies having a short length, only the leading portion of the photoconductive surface is used as an image forming area A′ as shown in FIG. 2 (II), with the result that this portion of the photoconductive member is locally deteriorated and becomes unserviceable in a short period of time. Moreover, the copying operation is inefficient since the copying speed is constant irrespective of the length of the original.

According to the present invention, the photoconductive member is rotated in the second revolution by an amount corresponding to the length of the original (image forming area) plus a small amount indicated at l in FIG. 2 (III) as already described. As a result, the leading end a of the image forming area C″ for the second copy is positioned at a small distance (length l) from the rear end b of the image forming area A″ (indicated at B″ on the surface in the second revolution in FIG. 2 (III)) for the first copy as seen in FIG. 2 (III). Thus when making short copies, the photoconductive member in the second revolution does not carry out idle rotation for the balance of rotation B, as it does in the situation shown in FIG. 2 (II). This results in a corresponding increase in the copying speed and efficiency of operation. Additionally the shift of the image forming area on the photoconductive member takes place at every copying cycle, eliminating any memory effect on the member and local degradation thereof, thus assuring a prolonged life. Since the photoconductive member is driven an additional distance (i.e. small length l in FIG. 2 (III)) to cause the rear end b of the image forming area on the photoconductive member to pass the charging unit 4, the rear end b of the image forming area used for the first copy is moved out of the region in which it is susceptible to the influence of the charging and discharging units 3 and 4 when the apparatus starts to make the second copy. The problem of the residual toner being likely to stain some components or cause deterioration of copied images when it is scattered will not occur.

On completion of the above described copying operation, the photoconductive member will remain partly uncleaned in the area from the rear end b to the cleaning blade 8 shown in FIG. 1. The residual toner in this area, even if left unremoved, will present no problem since it is removed by the cleaning blade 8 during the first turn of the drum 1 when the apparatus is used again. However, on completion of the last copying cycle, the drum 1 may be driven one further turn for the complete removal of the toner. Although the cleaning blade 8, which is held in contact with the photoconductive surface at all times, will come into contact with the latent image bearing area during the first revolution of the drum, the image remains intact since the blade 8 is made of insulating material.

Figure 3:
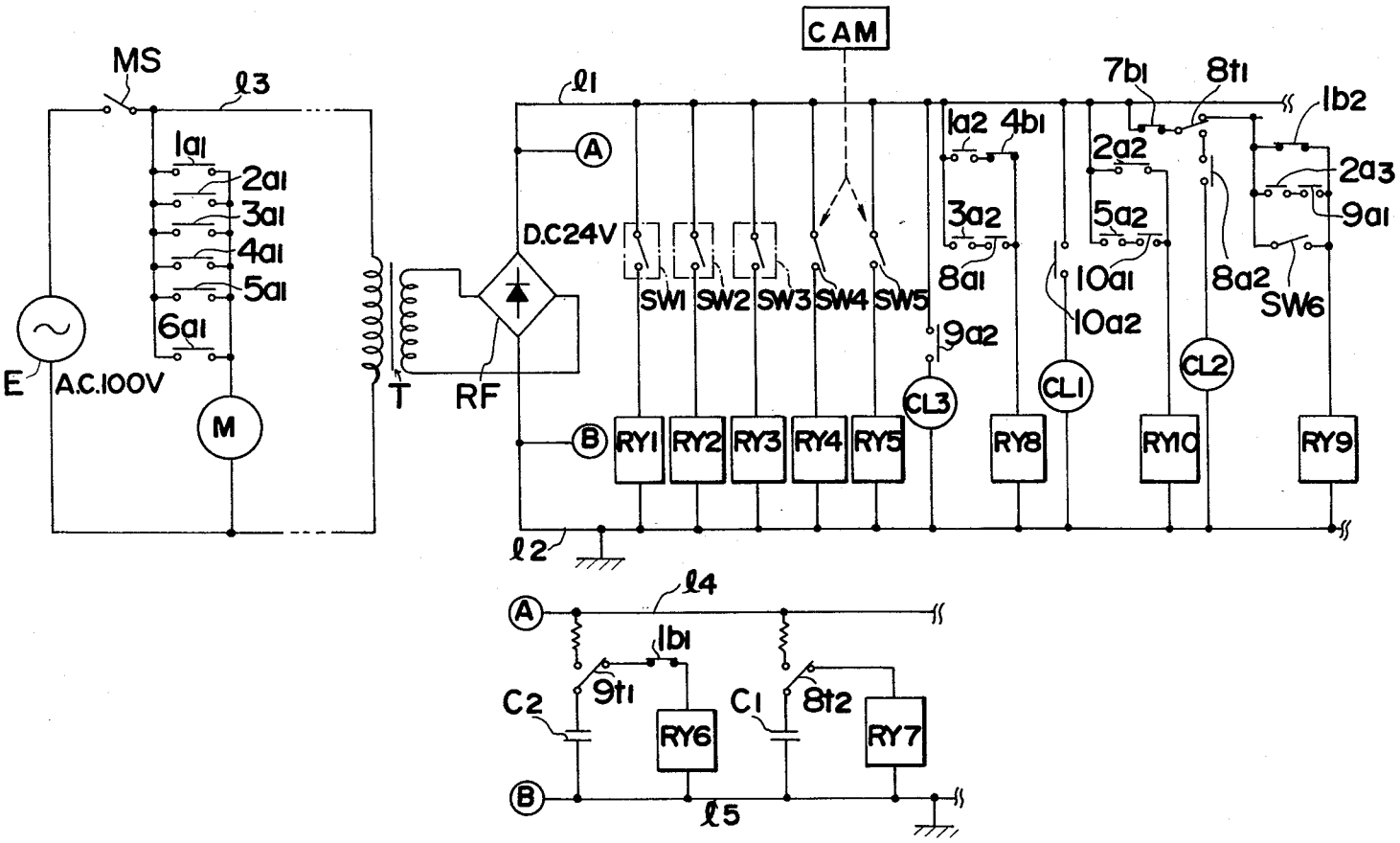
FIG. 3 is a circuit diagram of a control circuit therefor.

The circuit for performing the above described operation will be described below with reference to FIG. 3.

Figure 4:
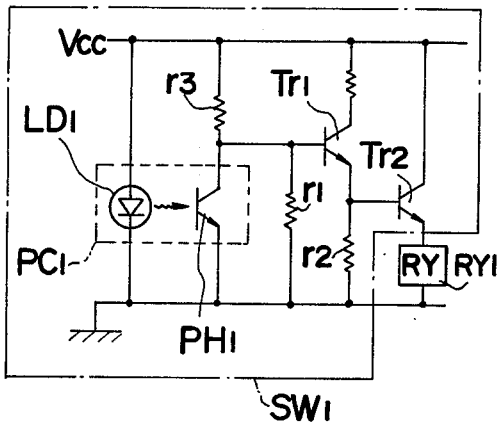
FIG. 4 is a circuit diagram of a switching circuit incorporating a photocoupler.

The circuit has switching circuits SW1, SW2 and SW3 including respective photocouplers PC1, PC2 and PC3 comprising respective light projecting elements LD1, LD2 and LD3 and light receiving elements PH1, PH2 and PH3. A circuit diagram of switching circuit SW1 is shown in FIG. 4. For simplification, these switching circuits are each shown in FIG. 3 as a simple switch. With reference to FIG. 4 (which shows only the switching circuit SW1 since circuits SW1 to SW3 have substantially the same construction), the light projecting element LD1 supplies light to the light receiving element PH1. The state of the element PH1 when it is receiving light corresponds to the open state of the switch SW1 in FIG. 3, because when irradiated with light, the element PH1 is conductive, thus making transistors Tr1 and Tr2 non-conductive.

When the element LD1 is shielded from light by an original fed to the apparatus, the element PH1 is made non-conductive. Consequently a voltage is applied to the base of the transistor Tr1 through a resistor r1, turning the transistor Tr1 on, whereupon the voltage across a resistor $r_2$ is fed to the base of the transistor Tr2, making the transistor Tr2 conductive. This state coincides with the closed state of the switch SW1. The construction shown in FIG. 4 is an example of a well-known switching circuit.

With reference to FIG. 3 again, switches SW4 and SW5 are operated by cam means (not shown) which in turn is operated in timed relation to the copying operation, for example by being driven by the driving means for drum 1. As will be described later, the switch SW4 controls the solenoid SL for the stop 34, etc. The switch SW5 stops the operation of the cam means, for example interrupting the power supply to the drive for the drum 1.

The group of switches SW1 to SW5 and a multicopy switch SW6 and relays RY1 to RY5 respectively connected in series therewith are connected across d.c. voltate supply lines l1 and l2 along with other relays RY8 to RY10. Other relays RY6 and RY7 and capacitors C1, C2, etc, are connected across power supply lines l4 and l5. A.c. power supply E supplies, by means of a transformer T and a rectifier RF, d.c. voltage to the supply lines l1, l2. Connected to a.c. voltage supply lines l3 are the main motor M for driving the photoconductive drum 1, and switch MS and relay contacts 1a1—6a1, and connected across d.c. voltage supply lines l1 and l2 are a cam clutch CL1 for transmitting torque to the cam means, a forward clutch CL2 for transmitting power to the feed rollers 21 and 22, etc. for advancing the original, a reverse clutch CL3 for delivering power to the feed rollers for reverse feeding the original, and corresponding relay contacts.

The circuit of FIG. 3 operates in the following manner. Although FIG. 3 shows only the elements relating to the operation of the photoconductive drum 1 and for the transport of the original and the transfer cards, it will be understood that the copying apparatus includes conventional circuits for controlling the charging, exposure, development and transfer steps. In respect of these steps, only the timing involved will be described. With the description given below, one skilled in the art will fully understand the operation of the present apparatus.

When the main switch MS is closed, d.c. voltage is fed to the supply lines l1 and l2 by the transformer T and rectifier RF, and the elements LD1 and LD3 emit light. When an original is subsequently fed to the apparatus, the element LD1 is shielded from the light, energizing the switching circuit SW1 (closing SW1 in FIG. 3) and the relay RY1, with the result that the normally open contacts 1a1 and 1a2 are closed, and normally closed contact 1b1 and 1b2 is opened. With the closing of the contact 1a1, the main motor M starts to rotate, starting rotation of the drum 1. The closed contact 1a2 energizes the relay RY8, closing a normally open contact 8a1 and 8a2 and switching contacts 8t1 and 8t2. Then the contact 8t1 is switched, the forward clutch CL2 is energized, starting rotation of the feed rollers 21 and 22 for transporting an original. When the contact 8t2 is switched, a charge is supplied to the capacitor C1.

When the switch SW1 is closed, the eraser lamp 18 is also turned on. This can be accomplished by connecting the eraser lamp 18 to the power supply lines l3 by a contact closed by the relay RY8.

When the light from the element LD2 is blocked by the original during transport (when the switch SW2 is closed), the relay RY2 is energized, whereby the contacts 2a1, 2a2 and 2a3 are each changed from the normally open to the closed position. When the contact 2a1 is closed, the main motor M continues to rotate even after the switch SW1 is opened after the passage of the rear end of the original through the photocoupler PC1. The contact 2a2, when closed, energizes the relay RY10, whereby normally open contacts 10a1 and 10a2 are closed. The closed contact 10a2 actuates the cam operating clutch CL1, starting operation of the cam means.

The switch SW2, when closed, also turns on the developing unit 3, the charging unit 4 and the exposure lamp 6. The image of the original is thus formed on the photoconductive drum 1 as an electrostatic latent image. Simultaneously with this, the card dispenser roller 28a is driven to deliver a transfer card 26. The rotation of the dispenser roller 28 is automatically stopped, for example, by suitable timer means (not shown) after the card 26 has been engaged in the nip of the feed rollers 30a and 30b.

The front end of the original thereafter blocks the light from the element LD3 (switch SW3 closes), whereon the relay RY3 is energized, thereby closing normally open contacts 3a1 and 3a2. The closed contact 3a1 causes continued rotation of the main motor M even after the rear end of the original has passed the photocoupler PC2. The closed contact 3a2 keeps the relay RY8 energized even after the rear end of the original has passed the photocoupler PC1.

The closing of the switch SW3 also causes the developing unit 11 to start to operate.

The original advances during exposure, opening SW1 and SW2 in succession and deenergizing the relays RY1 and RY2 to return their contacts to the illustrated position.

On the other hand, the aforementioned cam means turns on the switch SW4 immediately before the rear end of the original passes the photocoupler PC3, thereby energizing the relay RY4 to close a normally open contact 4a1, causing continued rotation of the main motor M. At the same time, a contact 4b1 shifts from a normally closed to an open position.

The closing of the switch SW4 also energizes the solenoid SL connected to the top 34, turns the transfer unit 17 on and the discharging and charging units 3 and 4 off. After a suitable delay provided by a suitable timer (not shown), the exposure lamp 6 is turned off. Accordingly the portion of the photoconductive surface finally exposed is the rear end of the image forming area. It therefore follows that the drum 1 has travelled a distance corresponding to the area A" shown in FIG. 2 (III) during the first revolution. The time at which the switch SW4 is closed is so set that the solenoid will operate to allow the front end of the card 26 to move into the transfer unit in coincidence with the front end of the image forming area. The length of the original or the arrangement of the elements within the apparatus must be such that this time precedes the opening of the switch SW3, namely the moment when the rear end of the original passes the photocoupler PC3.

When the switch SW3 is opened, the relay RY3 is deenergized, and the contact 3a2 is opened, turning off the relay RY8 and returning the contact 8t1 to the illustrated position, so that the forward clutch CL2 is deenergized. Simultaneously with this, the contact 8t2 returns to the illustrated position. The charge on the capacitor C1 energizes the relay RY7, holding the contact 7b1 open only during the discharge of the capacitor C1. As a result, the relay RY9 is energized through contacts 7b1, 8t1 and 1b2, after a delay corresponding to the duration of discharge of the capacitor C1. The closing of the normally open contact 9a2 by relay 9 energizes the reverse clutch CL3 to automatically feed the original in the reverse direction.

With the reverse feed of the original, the switches SW3, SW2 and SW1 are closed in succession and then opened in the recited order. When the original is fed in reverse, opening the switch SW2, with switch SW1 held closed (the contact 1b2 held opened), the contact 2a3 of the relay RY2 opens to break the circuit to relay 9 to deenergize the reverse clutch CL3. Under the control of the cam means, the switch SW4 is held closed until the switch SW2 is opened during the reverse feed of the original.

The operation of the copying apparatus during the reverse feed of the original when making one copy differs from the corresponding operation of the apparatus for making a plurality of copies from the same original continuously.

The multicopy switch SW6 is open when producing a plurality of copies and is closed when making only one copy. It is operatively associated with an unillustrated copy number setting means. Since the switch SW6 is open when making a plurality of copies, the contact 2a3 is open and the relay RY9 is deenergized to open the contact 9a2 when the switch SW2 is opened by the reversely fed original which passes the photocoupler PC2. The reverse clutch CL3 is therefore turned off to stop the reverse feed of the original. When the switch SW4 is subsequently opened by the movement of the cam means, the contact 4b1 of the relay RY4 is closed, so that the relay RY8 is reenergized to change over the contact 8t1 and close the contact 8a1. The forward clutch CL2 is actuated to automatically repeat the foregoing copying operation by the advancing of the original.

The advance of the original and copying operation are restarted at an intermediate position of the second revolution of the drum 1 as shown in FIG. 2 (III), such that the front end a of the image forming area C″ for the restarted operation is spaced a distance l from the rear end b of the preceding image forming area B″. The distance or length l must be provided in order for the rear end b of the area B″ to pass the charging unit 4 as already described and is the distance between the point a in FIG. 1. corresponding to the front end of the second image forming area C″ and the point b shown in FIG. 1 and corresponding to the rear end of the first image forming area B″. Since the rear end of the first image forming area B″ is initially positioned at the point a in FIG. 1 when the distance l is not provided, it is theoretically possible to start the formation of the second image immediately at this point as stated before. The uncleaned portion of the area B″ would then be brought to the position below the discharging and charging units 3 and 4, with the result that the toner would be scattered upon energization of the units 3 and 4 for the formation of the second image. The rotation of the drum over the distance l eliminates such an undesirable result.

Since the switch SW6 is closed when making one copy and during the last rotation of the drum when making a plurality of copies, the original during its reverse feed is not stopped despite the deenergization of the relay RY2 but continues to move. When the original has been completely delivered from the feeder 19 after passing the photocoupler PC1, the motor is deenergized to complete the copying operation. Indicated at 6a1 is a contact of the relay RY6 which operates during the discharge of the capacitor C2 when the contact 9t2 of the relay RY9 and contact 1b1 of the relay RY1 are switched to keep the motor M rotating. In the meantime, the residual toner is removed from the drum 1. A delay circuit may be provided if desired.

Figure 5:
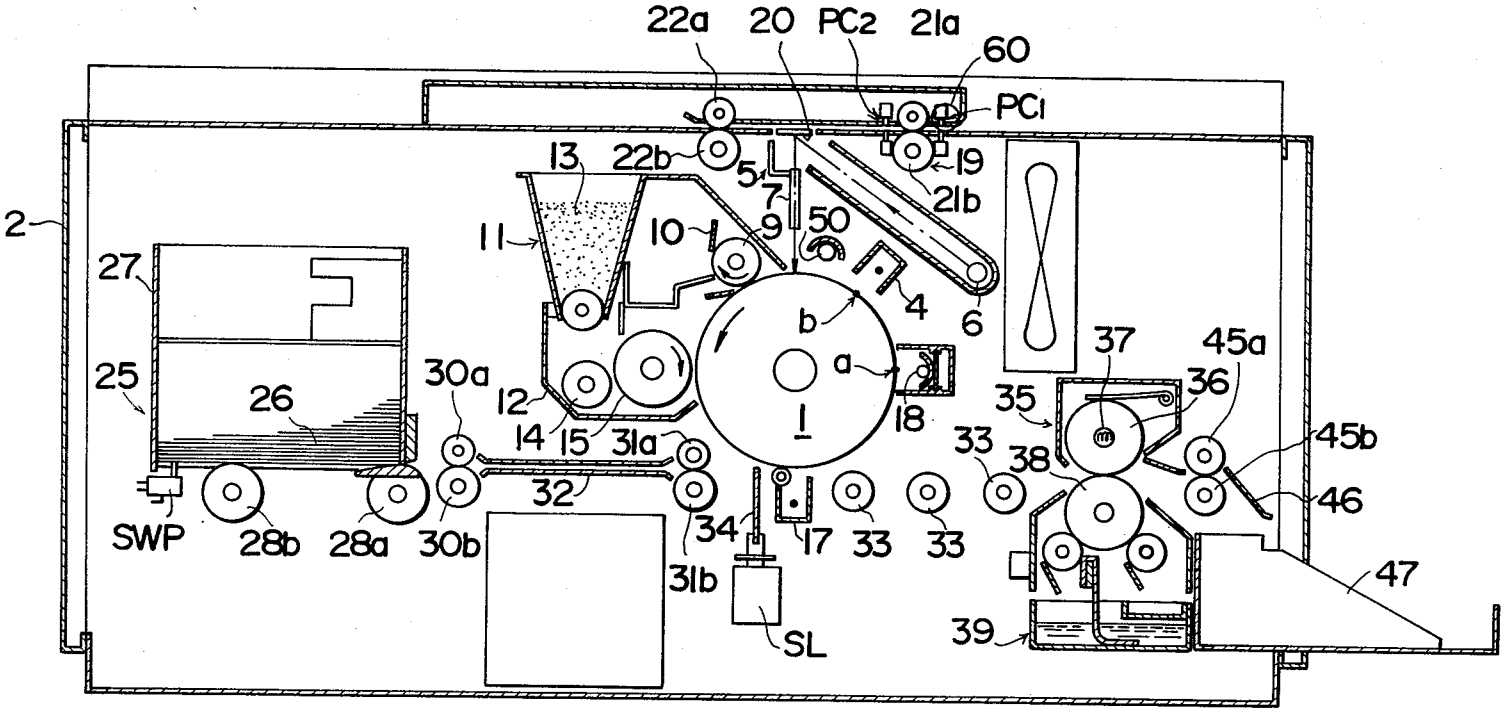
FIG. 5 is a sectional side elevation view showing another embodiment of an electrophotographic copying apparatus according to this invention.

Although this invention has been described above with reference to the construction illustrated in FIG. 1, the elements arranged around the photoconductive drum 1, original feeder, etc. can be modified if desired. As shown in FIG. 5 for example, the discharging unit 3 may be replaced by a second eraser 50 for erasing the charges between the image forming areas. A discharge roller 60 rotatable in a reverse direction and in timed relation to the original feed rollers 21a and 21b may be provided in front of the rollers 21a and 21b for moving the original completely away from the photocoupler PC1 when it is fed in the reverse direction.

The photocoupler PC3 included in the circuit described may be replaced by a timer the operation of which is initiated by the photocoupler PC2 for the reverse feed of the original. In this case, the signal may be provided by the front end of the original for use with originals of definite length or by the rear end of the original when originals of varying lengths are to be copied. Further in place of the cam means, a timer or timers having suitable time settings are of course usable. Signals for actuating the timers can be provided in a manner similarly to that described above.

It will be apparent from the description given above that in a copying apparatus of the type in which the photoconductive member is adapted to make two revolutions for each copying cycle, the present invention provides a construction wherein at least charging, exposure and developing units are operated during the first revolution of the photoconductive member to form an image thereon, and the photoconductive member is thereafter rotated in the second revolution until the rear end of the image forming area on the member has passed the charging unit. The toner recovered by cleaning is made reusable by a simple arrangement, and in this respect the present apparatus has an advantage inherent in the apparatus of the type described, while the present invention has overcome the drawbacks of like apparatus heretofore known. Moreover, the present apparatus does not require unnecessary idle rotation of the photoconductive member and partial degradation thereof, ensuring an efficient copying operation at an increased speed and insuring a prolonged life for the photoconductive member. Additionally the apparatus does not permit the scattering of the residual toner which otherwise would stain the interior of the machine or the copy image.

We claim:

1. An electrophotographic copying apparatus comprising a rotatable drum means having an endless photoconductive surface with a circumferential length greater than the maximum length of the original to be copied; a charging means for charging the photoconductive surface; exposure means for projecting an optical image of an original to be copied onto the charged photoconductive surface and having an exposure lamp, scanning means for scanning the original, and an optical system; developing means for developing an electrostatic latent image formed on the photoconductive surface by means of toner particles and including means for removing toner particles from the photoconductive surface; transfer means for transferring the toner image formed on the photoconductive surface to copying material; erasing means for erasing the residual charges on the photoconductive surface; said charging means, exposure means, developing means, transfer means and erasing means being spaced around said drum in the recited order; and control means for controlling the operation of the apparatus and having:

first signal generating means connected to said drum means and said scanning means for generating a first signal for initiating rotation of said drum means and initiating operation of said scanning means for scanning an original in the scanning direction;

second signal generating means connected to said exposure lamp and said charging means for generating a second signal for energizing said exposure lamp and said charging means at the initiation of the operation of said scanning means for successively forming an electrostatic latent image on said drum during the first revolution of said drum, means responsive to completion of scanning the original and connected to said exposure lamp, charging means and scanning means for deenergizing said exposure lamp and said charging means and stopping the scanning operation of said scanning means;

means responsive to completion of scanning of the original and connected to said scanning means for driving the scanning means in the direction opposite the scanning direction for returning the original to the start position; and selectively actuable means connected to said drum means and said first signal generating means for continuing rotation of said drum for making a plurality of copies and for actuating said first signal generating means for obtaining a second copy of the original in the second revolution of said drum after a delay sufficient to permit passage of the trailing end of a previously formed image past said charging means.

2. An electrophotographic copying apparatus comprising a rotatable drum means having an endless photoconductive surface with a circumferential length greater than the maximum length of the original to be copied; a charging means for charging the photoconductive surface; exposure means for projecting an optical image of an original to be copied onto the charged photoconductive surface and having an exposure lamp, scanning means for scanning the original, and an optical system; developing means for developing an electrostatic latent image formed on the photoconductive surface by means of toner particles; transfer means for transferring the toner image formed on the photoconductive surface to copying material; erasing means for erasing the residual charges on the photoconductive surface; said charging means, exposure means, developing means, transfer means and erasing means being spaced around said drum in the recited order; cleaning means for removing the residual toner particles from the photoconductive surface disposed between the exposure means and the developing means; and control means for controlling the operation of the apparatus and having:

first signal generating means connected to said drum means and said scanning means for generating a first signal for initiating rotation of said drum means and initiating operation of said scanning means for scanning an original in the scanning direction;

second signal generating means connected to said exposure lamp and said charging means for generating a second signal for energizing said exposure lamp and said charging means at the initiation of the operation of said scanning means for successively forming an electrostatic latent image on said drum during the first revolution of said drum, means responsive to completion of scanning the original and connected to said exposure lamp, charging means and scanning means for deenergizing said exposure lamp and said charging means and stopping the scanning operation of said scanning means;

means responsive to completion of scanning of the original and connected to said scanning means for driving the scanning means in the direction opposite the scanning direction for returning the original to the start position; and selectively actuable means connected to said drum means and said first signal generating means for continuing rotation of said drum for making a plurality of copies and for actuating said first signal generating means for obtaining a second copy of the original in the second revolution of said drum after a delay sufficient to permit passage of the trailing end of a previously formed image past said charging means.

3. An electrophotographic copying apparatus as claimed in claim 2 or claim 1 in which said first and second signal generating means and said means for deenergizing said exposure lamp and said charging means and said means for returning the original each comprise a photocoupler positioned along the path of the original through said scanning means and responsive to the passage of the original past the photocoupler.

4. An electrophotographic copying apparatus comprising: a rotatable drum member having an endless photoconductive surface; a charging means for charging the photoconductive surface; exposure means for projecting an optical image of an original to be copied onto the charged photoconductive surface and having an exposure lamp, scanning means for scanning the original and an optical system; developing means for developing an electrostatic latent image formed on the photoconductive surface by means of toner particles and including means for removing the toner particles from the photoconductive surface; transfer means for transferring the toner image formed on the photoconductive surface to copying material; erasing means for erasing the residual charges on the photoconductive surface; said charging means, exposure means, developing means, transfer means and erasing means being spaced around said drum member in the recited order; and control means connected to the respective means for electrically controlling the operation of at least the charging, exposing, developing, transfer and erasing means relative to the scanning means and the rotation of the photoconductive drum, for controlling; when continuously making a plurality of copies from the same original, the charging, exposure, developing and the transfer means during the first rotation of the photoconductive drum for forming of the image for the first copy to form the toner image thereon, and for operating at least the charging and exposure means during the second and subsequent rotation of the photoconductive drum to start the second and subsequent image forming operation when the tail end of the first and subsequent image area on the photoconductive surface has passed a portion of said charging means.

5. An electrophotographic copying apparatus comprising: a rotatable drum member having an endless photoconductive surface; a charging means for charging the photoconductive surface; exposure means for projecting an optical image of an original to be copied onto the charged photoconductive surface and having an exposure lamp, scanning means for scanning the original and an optical system; developing means for developing an electrostatic latent image formed on the photoconductive surface by means of toner particles; transfer means for transferring the toner image formed on the photoconductive surface to copying material; erasing means for erasing the residual charges on the photoconductive surface; said charging means, exposure means, developing means, transfer means and erasing means being spaced around said drum member in the recited order; cleaning means for removing the residual toner particles from the photoconductive surface disposed between the exposure means and the developing means; and control means connected to the respective means for electrically controlling the operation of at least the charging, exposing, developing, transfer and erasing means relative to the scanning means and the rotation of the photoconductive drum, for controlling, when continuously making a plurality of copies from the same original, the charging, exposure, developing and the transfer means during the first rotation of the photoconductive drum for forming of the image for the first copy to form the toner image thereon, and for operating at least the charging and exposure means during the second and subsequent rotation of the photoconductive drum to start the second and subsequent image forming operation when the tail end of the first and subsequent image area on the photoconductive surface has passed a portion of said charging means.

* * * * *